US010382859B2

(12) United States Patent
Lembacher et al.

(10) Patent No.: US 10,382,859 B2
(45) Date of Patent: Aug. 13, 2019

(54) LOUDSPEAKER WITH A GAS ADSORBING MATERIAL AND MOBILE DEVICE COMPRISING A LOUDSPEAKER

(71) Applicant: Sound Solutions International Company, Ltd., Beijing (CN)

(72) Inventors: Christian Lembacher, Gramtneusiedl (AT); Christoph Schmauder, Vienna (AT); Gordon Schriefer, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 15/813,956

(22) Filed: Nov. 15, 2017

(65) Prior Publication Data

US 2018/0146282 A1 May 24, 2018

Related U.S. Application Data

(60) Provisional application No. 62/424,008, filed on Nov. 18, 2016.

(51) Int. Cl.
*H04R 1/02* (2006.01)
*H04R 1/28* (2006.01)

(52) U.S. Cl.
CPC ..... *H04R 1/2803* (2013.01); *H04R 1/02* (2013.01); *H04R 1/288* (2013.01); *H04R 1/2873* (2013.01); *H04R 2201/029* (2013.01); *H04R 2499/11* (2013.01)

(58) Field of Classification Search
CPC ... H04R 1/00; H04R 1/02; H04R 1/28; H04R 1/2803; H04R 1/2811; H04R 1/2834; H04R 2499/11
See application file for complete search history.

(56) References Cited

U.S. PATENT DOCUMENTS

2009/0245562 A1* 10/2009 Saiki ..... H04R 1/2803 381/345
2013/0170687 A1 7/2013 Papakyriacou et al.
2017/0013350 A1* 1/2017 Sauer ..... H04R 1/2803

* cited by examiner

*Primary Examiner* — Brian Ensey
(74) *Attorney, Agent, or Firm* — Steven McMahon Zeller; Dykema Gossett PLLC

(57) ABSTRACT

A loudspeaker comprises an enclosure, at least one dynamic driver mounted in the enclosure, and at least one porous monolithic block comprises of a gas adsorbing material and a binder. The at least one porous monolithic block comprises a plurality of pores and is mounted within the enclosure.

8 Claims, 3 Drawing Sheets

LOUDSPEAKER WITH A GAS ADSORBING MATERIAL AND MOBILE DEVICE COMPRISING A LOUDSPEAKER

CROSS REFERENCE TO RELATED APPLICATION

This application claims the benefit of provisional application Ser. No. 62/424,008 filed on Nov. 18, 2016, the contents of which are incorporated herein by reference in its entirety.

TECHNICAL FIELD

The disclosure relates to a loudspeaker with a gas adsorbing material and to a method of manufacturing a loudspeaker. The disclosure also relates to a mobile device, such as a mobile phone, comprising a loudspeaker with a gas adsorbing material.

BACKGROUND

European patent No. 2 424 270 B1 discloses a loudspeaker which comprises an enclosure and a dynamic driver mounted in the enclosure. The enclosure is filled with a gas adsorbing zeolite material. Filling the enclosure with the gas adsorbing zeolite material results in an apparent virtual enlargement of the volume defined by the enclosure, increasing the effective volume of the enclosure. The gas adsorbing zeolite material comprises grains having an average grain size in a range between 0.2 and 0.9 mm and having a plurality of zeolite particles adhered together by means of a binder. The zeolite particles comprise pores and have a silicon to aluminum mass ratio of at least 200.

SUMMARY

It is an object of the present disclosure to provide a loudspeaker comprised of an enclosure and a dynamic driver mounted in the enclosure, which loudspeaker comprises increased acoustic properties.

The object of the disclosure is achieved by means of a loudspeaker, comprising an enclosure; at least one dynamic driver mounted in the enclosure; at least one resonance space defined within the enclosure, said resonance space may be filled with a gas adsorbing material comprising porous particles and a binder; the particles being embedded in the binder; and the binder having a solid content of at least 30 percent by weight with regard to the total weight of the binder.

It has been found that an increase in molecular weight of the binder is beneficial for acoustic effect. Due to the high solid content of the binder the acoustic properties of the loudspeaker are increased very much.

By means of the disclosure the Sound Pressure Level SPL can be increased in certain frequency bands. Therefore, the customer specification can be fulfilled more easily and the time to market can be reduced. In particular, the way of processing the gas adsorbing material according to the disclosure allows better usage of the effect of increasing the acoustic volume and/or acoustic compliance respectively in small cavities and back volumes.

According to an embodiment the binder has a solid content of at least 50 percent by weight with regard to the total weight of the binder. Preferably, the binder has a solid content between 50 and 90 percent by weight with regard to the total weight of the binder. According to an embodiment the binder has a solid content between 55 and 75 percent by weight with regard to the total weight of the binder. According to another embodiment the binder has a solid content of 100 percent by weight with regard to the total weight of the binder.

Another aspect of the disclosure relates to a mobile device comprising a loudspeaker according to the disclosure. The mobile device is, for instance, a mobile telephone.

The loudspeaker comprises the enclosure. The enclosure is preferably a sealed enclosure. Sealed loudspeaker enclosures are also referred to as closed enclosures.

The loudspeaker comprises at least one dynamic driver. Dynamic drivers per se are known to the skilled person. Dynamic drivers usually comprise a magnet system, a membrane movably mounted with respect to the magnet system, and a voice coil attached to the membrane. The magnet system comprises a magnet and the voice coil is operatively coupled with the magnet. When applying an electric signal to the voice coil, for instance, generated by an amplifier, then the membrane moves in response to the electric signal. The electric signal is, for instance, an electric voltage.

The enclosure provides a volume, specifically a back volume constituting a resonance space for the dynamic driver.

The loudspeaker further comprises the gas adsorbing material containing the porous particles and the binder which is mounted within the enclosure. The gas adsorbing material is preferably placed within the back volume for the dynamic driver. Preferably the at least one resonance space is tightly filled with the gas adsorbing material.

Especially, the porous particles may comprise zeolite particles. In particular, the zeolite particles may be those described and disclosed in U.S. Patent Publication U.S. 2013/0170687 A1 (equivalent to publication EP 2 424 270 B2), the disclosure of which is hereby incorporated by reference in its entity. The zeolite particles may have diameters of 10 μm in diameter or smaller. Alternatively, the porous particles may comprise or consist of activated carbon.

According to a preferred embodiment the binder comprises at least one sodium carboxymethyl cellulose (CMC) [CAS: 9004-32-4] and/or at least one poly carbon acid and/or at least one acrylate and/or at least one acrylate-polymer or at least one acrylate-copolymer, and/or bentonite [CAS: 1302-78-9] and/or Glycerin [CAS: 56-81-5] and/or Ethylene-glycol [CAS: 107-21-1] and/or at least one methacrylic ester-acrylic ester copolymer. (The "CAS" numbers are the identifiers assigned by the Chemical Abstracts Service.)

Sodium carboxymethyl cellulose, or CMC, is a good binder, which gives relatively hard materials and good acoustic properties. Alternatively, a commercially available binder from company Zschimmer and Schwarz, having the trade name Optapix AC15 (a poly carbon acid mixture) can be used and also gives very good acoustic results. Also combinations of binder can be used to achieve a certain hardness. For example Bentonite gives very hard granules. On the other hand the previously mentioned granulates prepared with CMC are softer. Therefore to obtain a certain hardness, different binder materials can be used to obtain a certain property profile. Alternatively, CMC can be mixed with Glycerin or Ethylene glycol to obtain a more softer granulate. An amount of Glycerin or Ethylene glycol is typically 1 m % of remaining binder such as CMC. A methacrylic ester-acrylic ester copolymer that can be used as binder has become known under the trade name PLEXTOL M 615.

The binder may be a radiation curing binder. In an embodiment the binder is a solvent based binder, wherein curing is performed by evaporation of a solvent.

According to an embodiment, in relation to the whole mass of the gas adsorbing material the mass fraction of the binder is in the range from 1% to 20%. According to a further embodiment, in relation to the whole mass of the gas adsorbing material the mass fraction of the binder is in the range from 2% to 10%. According to a further embodiment, in relation to the whole mass of the gas adsorbing material the mass fraction of the binder is in the range from 4% to 6%.

The gas adsorbing material comprising the porous particles and the binder may be in the form of a granulate. To achieve the granulate individual porous particles are adhered together by means of the binder resulting in grains of particles, which grains are larger than a single particle. The granulate may consist of a plurality of individual grains having a grain size between 50 μm-1.33 mm. The granulate may be produced by providing a plurality of porous particles and the binder. Then, the binder and the plurality of particles are mixed together resulting in a particle-binder mixture. The particle-binder mixture is then processed to obtain grains of a desired diameter.

The particle-binder mixture can be of a liquid form, for example a slurry, suspension, etc. The slurry or suspension may be obtained by: (a) preparing a porous particle (zeolite or another appropriate gas adsorbing material) suspension with an organic solvent, for example alcohol, wherein the porous particles have a mean particle diameter smaller than 10 μm or, according to another embodiment, smaller than 2 μm; (b) homogenizing the porous particle suspension by, for example, stirring, and (c) mixing the homogenized porous particle suspension is mixed with a binder suspension.

According to an embodiment the solid content of the binder and the porous particles having the form of powders may be mixed and afterwards a solvent may be added to a resulting mixture of these components to obtain a slurry. Processing of the particle-binder mixture can be done by means of drying. Drying can be performed in different ways, for example by means of a fluidized bed, a spray method (drops of the mixture may be freeze dried) or by pouring the resultant suspension onto a hot plate (according to various embodiments, the temperature of the plate range is in a range between 120 degrees Celsius and 200 degrees Celsius or between 150 degrees Celsius and 170 degrees Celsius). According to an embodiment the particle-binder mixture is filled into a drum and the granulate is produced by rotating the drum. The drum may be heated to enhance drying and curing of the particle-binder mixture.

If the grains of the resultant solid are larger than desired, the resultant solid may be cut or broken into smaller pieces for example by means of a mortar mill, a hammer rotor mill, a cutting mill or a oscillating plate mill. Subsequently, the resultant solid (optionally cut or broken) is screened with sieves to obtain grains in a desired diameter range.

Alternatively, the gas adsorbing material containing the porous particles may be in the form of a porous monolithic block. Particularly, the porous monolithic block comprises a plurality of first pores. Preferably, the first pores have a size or diameter between 0.7 μm and 30 μm. In part due to the first pores, the effective volume of the loudspeaker, i.e., the effective back volume for the dynamic driver, is greater than the back volume without any porous gas adsorbing material resulting in a potential increased sound quality of the entire loudspeaker. Particularly, due to the porous monolithic block, a resonance frequency of the entire loudspeaker may be reduced compared to the resonance frequency of the loudspeaker without any porous gas adsorbing material. Therefore, it may be possible to reduce the overall volume of the loudspeaker or its enclosure, respectively, allowing to manufacture a relatively small loudspeaker especially having an improved or at least an acceptable sound quality when, for instance, using it for a mobile device, such as a mobile phone.

The porous monolithic block may be produced through a freezing casting method, starting with providing a plurality of porous particles, the binder and a mold whose contour corresponds to the contour of the enclosure or a relevant portion of the enclosure, i.e., a sub-enclosure. Then, the binder and the plurality of particles may be mixed with the mixture and then filled into the mold. The mold may then be frozen in order to produce the porous monolithic block. The mold is then removed from the porous monolithic block. A modified method may be a ceramic foaming method.

The porous monolithic block may be produced using a freezing foaming method, by providing a plurality of porous particles, the binder and a mold whose contour corresponds to the contour of the enclosure or the relevant sub-enclosure. Then, the binder and the plurality of particles may be mixed and then filled into the mold. The mold is then enclosed and the ambient pressure around the mold is reduced in order to produce the porous monolithic block. The mold is then removed from the porous monolithic block.

The porous monolithic block may be produced through a sintering method by providing a plurality of porous particles, the binder and a mold whose contour corresponds to the contour of the enclosure or the relevant sub-enclosure. Then, the binder and the plurality of particles may be mixed, with the mixture and then filled into the mold. The mold may then be heated in order to produce the porous monolithic block. During the heating, the binder burns away at least partially. For example, two different kinds of binders may be used. One type of binder may be a temporary binder which burns away completely or almost completely during the heating creating the first pores. Another type of binder may not burn away during the heating. The mold is then removed from the porous monolithic block

BRIEF DESCRIPTION OF THE DRAWINGS

These and other aspects, features, details, utilities, and advantages of the disclosure will become more fully apparent from the following detailed description, appended claims, and accompanying drawings, wherein the drawings illustrate features in accordance with exemplary embodiments of the disclosure, and wherein:

DESCRIPTION OF THE EMBODIMENTS

Figure 1:
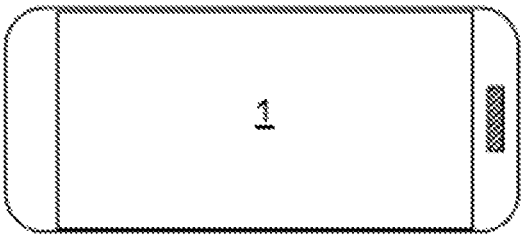
FIG. 1 is a top view of a mobile phone.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the disclosure described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "rear," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the disclosure described herein are, for example, capable of operation in other orientations than those illustrated or otherwise described herein.

All numbers expressing measurements and so forth used in the specification and claims are to be understood as being modified in all instances by the term "about."

FIG. 1 shows a mobile phone 1 as an example of a mobile device. The mobile phone 1 may comprise a microphone, a wireless sender-receiver unit, an amplifier and a central processing unit connected to the wireless sender-receiver unit and to the amplifier.

Figure 2:
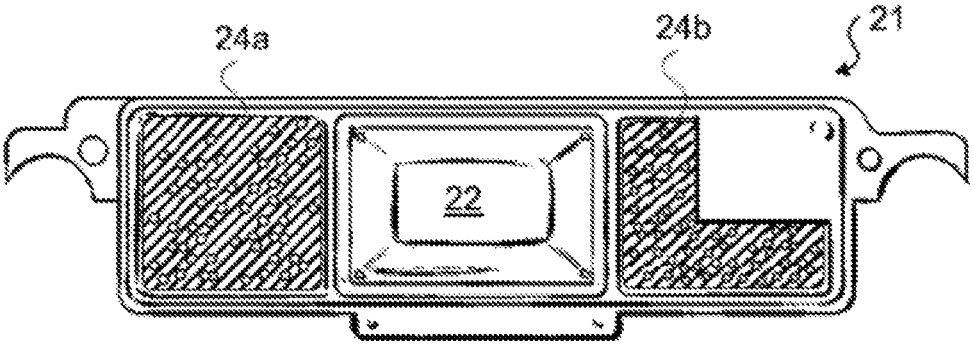
FIG. 2 is a top view of a loudspeaker comprising monolithic blocks, a dynamic driver and an enclosure which is shown open.

The mobile phone 1 comprises a loudspeaker 21 which is shown in FIG. 2. The amplifier of the mobile phone 1 may be connected to the loudspeaker 21.

The loudspeaker 21 comprises at least one dynamic driver 22. Dynamic drivers per se are known to the skilled person. Dynamic drivers usually comprise a magnet system, a membrane movably mounted with respect to the magnet system, and a voice coil attached to the membrane. The magnet system comprises a magnet and the voice coil is operatively coupled with the magnet. When applying an electric signal to the voice coil, for instance, generated by the amplifier, then the membrane moves in response to the electric signal.

The loudspeaker 21 comprises an enclosure 23 and a gas adsorbing material comprising porous particles and a binder mounted within the enclosure 23. The porous particles are embedded in the binder, wherein the binder comprises a solid content of at least 30 percent by weight with regard to the total weight of the binder. Preferably, the binder has a solid content between 50 and 90 percent by weight with regard to the total weight of the binder. According to an embodiment the binder has a solid content between 55 and 75 percent by weight with regard to the total weight of the binder.

In particular, the loudspeaker 21 comprises a first gas adsorbing material 24*a* comprising porous particles and a second gas adsorbing material 24*b* comprising porous particles. The gas adsorbing materials 24*a* and 24*b* are of the same chemical structure. The gas adsorbing materials 24*a* and 24*b* each may be in the form of a granulate or of a porous monolithic block.

According to a preferred embodiment the binder comprises at least one of the following materials: sodium carboxymethyl cellulose (CMC), poly carbon acid, acrylate, acrylate-polymer, acrylate-copolymer, bentonite, Glycerin, Ethylene-glycol and methacrylic ester-acrylic ester copolymer.

The binder may be a radiation curing binder. In an embodiment the binder is a solvent based binder, wherein curing is performed by evaporation of a solvent.

In relation to the whole mass of the gas adsorbing material the mass fraction of the binder may be in the range from 1% to 20%. According to a further embodiment, in relation to the whole mass of the gas adsorbing material the mass fraction of the binder is in the range from 2% to 10%. According to a further embodiment, in relation to the whole mass of the gas adsorbing material the mass fraction of the binder is in the range from 4% to 6%.

Figure 3:
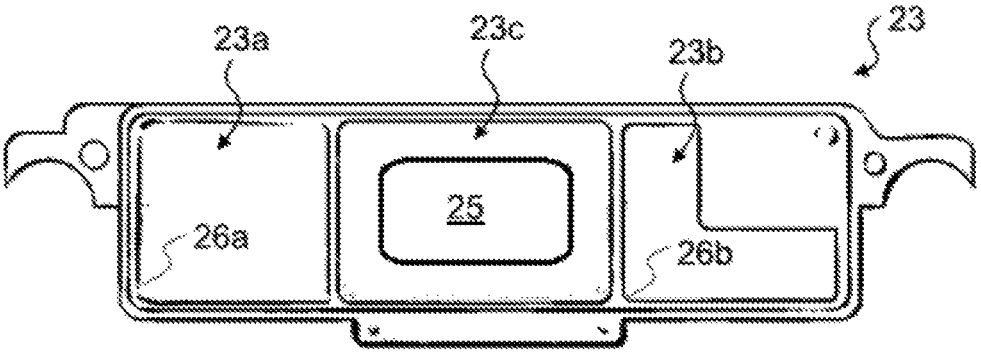
FIG. 3 is a top view of the opened enclosure.
Figure 4:
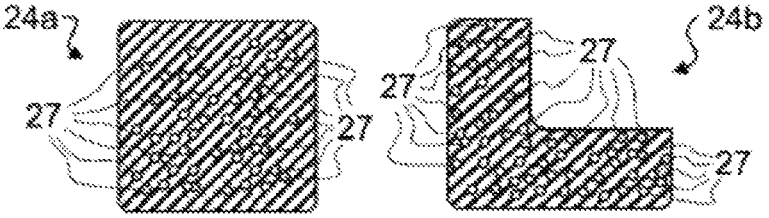
FIG. 4 are the monolithic blocks.

FIG. 2 shows in particular a top view of the loudspeaker 21 with its enclosure 23 opened. FIG. 3 shows a top view of the opened enclosure 23 and FIG. 4 shows the gas adsorbing materials 24*a*, 24*b*.

In the present embodiment, the enclosure 23 comprises a plurality of sub-enclosures, namely a first sub-enclosure 23*a*, a second sub-enclosure 23*b*, and a third sub-enclosure 23*c*. The sub-enclosures 23*a*, 23*b*, 23*c* are acoustically coupled to each other and form, as a result, the single enclosure 23 for the dynamic driver 22. In the present embodiment, the enclosure 23 is a sealed enclosure. Sealed enclosures are also known as closed enclosures.

The dynamic driver 22 is mounted in the third sub-enclosure 23*c*. In particular, the third sub-enclosure 23*c* comprises an aperture 25 in which the dynamic driver 22 is mounted. The gas adsorbing materials 24*a*, 24*b* are mounted within the enclosure 23. In the present embodiment, the first gas adsorbing material 24*a* is mounted within the first sub-enclosure 23*a*, and the second gas adsorbing material 24*b* is mounted within the second sub-enclosure 23*b*. The first and second sub-enclosures 23*a*, 23*b* may be identical or, as shown in the figures, may differ from each other.

In case the gas adsorbing materials 24*a*, 24*b* are in the form of porous monolithic blocks each of these blocks comprises first pores 27. Particularly, the first pores 27 have a diameter between 0.7 μm to 30 μm. Preferably, the gas adsorbing materials 24*a*, 24*b* comprise each a zeolite material or activated carbon as porous particles. Alternatively, the gas adsorbing materials 24*a*, 24*b* may be granules consisting of a plurality of individual grains having a grain size between 50 μm-1.33 mm.

The granulate may be produced by providing a plurality of porous particles and the binder. Then, the binder and the plurality of particles are mixed together resulting in a particle-binder mixture. The particle-binder mixture is then processed to obtain grains of a desired diameter.

The particle-binder mixture can be of a liquid form, for example a slurry, suspension etc. The slurry or suspension may be obtained through the steps of: (a) preparing a porous particle (zeolite or another appropriate gas adsorbing material) suspension with an organic solvent, for example alcohol, wherein the porous particles have a mean particle diameter smaller than 10 μm or, according to another embodiment, smaller than 2 μm; (b) homogenizing the porous particle suspension by, for example, stirring; and (c) mixing the homogenized porous particle suspension with a binder suspension.

According to an embodiment the solid content of the binder and the porous particles having the form of powders may be mixed and afterwards a solvent may be added to a resulting mixture of these components to obtain a slurry. Processing of the particle-binder mixture can be done by means of drying. Drying can be performed in different ways, for example by means of a fluidized bed, a spray method (drops of the mixture may be freeze dried) or by pouring the resultant suspension onto a hot plate (according to various embodiments, the temperature of the plate range is in a range between 120 degrees Celsius and 200 degrees Celsius or between 150 degrees Celsius and 170 degrees Celsius). According to an embodiment the particle-binder mixture is filled into a drum and the granulate is produced by rotating the drum. The drum may be heated to enhance drying and curing of the particle-binder mixture.

If the grains of the resultant solid are larger than desired, the resultant solid may be cut or broken into smaller pieces for example by means of a mortar mill, a hammer rotor mill, a cutting mill or a oscillating plate mill. Subsequently, the resultant solid (optionally cut or broken) is screened with sieves to obtain grains in a desired diameter range.

Due to the gas adsorbing material 24*a*, 24*b*, the effective acoustic volume of the enclosure 23 is greater than the volume of the enclosure 23 without the gas adsorbing material 24*a*, 24*b*.

Figure 5:
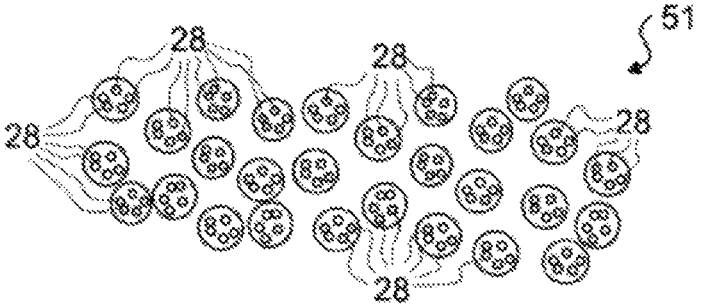
FIG. 5 is a plurality of particles.

In case the gas adsorbing materials 24*a*, 24*b* are in form of porous monolithic blocks the gas adsorbing material may be produced using a freezing casting method using a plurality of particles 51 shown in FIG. 5. The particles 51 may already be grains consisting of porous particles and the binder. Alternatively, the gas adsorbing materials 24*a*, 24*b* may be produced by a freezing foaming method using the plurality of particles 51, a sintering method using the plurality of particles 51, a ceramic foaming method using the plurality of particles 51, or a self-curing binding technique using the plurality of particles 51.

Figure 6:
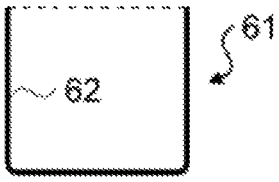
FIG. 6 is a mold.

For the aforementioned methods, an appropriate mold 61, as shown in FIG. 6, may be used. Particularly, the mold 61 is made from a material appropriate for the specific method. In particular, each porous monolithic block 24*a*, 24*b* may be made utilizing an individual mold 61. For instance, if the porous monolithic blocks are made utilizing the freezing casting method, then the mold 61 may at least partly be made from PTFE (Polytetrafluorethylen). Alternatively, if the porous monolithic blocks are made utilizing the freezing foaming method, then the mold 61 may at least partly be made from silicon rubber.

Preferably, the porous particles 51 are comprised or consist of a plurality of porous zeolite particles.

In the present embodiment, the shape of the first and second sub-enclosures 23*a*, 23*b* differ. In particular, the shape of the porous monolithic block 24*a*, 24*b* are adapted to the shape of the relevant sub-enclosures 23*a*, 23*b*, i.e. the shape of the first porous monolithic block 24*a* is adapted to the shape of the first sub-enclosure 23*a*, and the shape of the second porous monolithic block is adapted to the shape of the second sub-enclosure 23*b*. When using one of the aforementioned methods to produce the porous monolithic blocks, then, for instance, the mold 61 can be adapted to the shape of the relevant sub-enclosure 23*a*, 23*b*.

The enclosure 23 may have a contour. More specifically, the surface of the enclosure 23 facing towards the porous monolithic blocks 24*a*, 24*b* may have the contour. Preferably, the porous monolithic blocks 24*a*, 24*b* are mounted into the enclosure 23 in a form-fit manner corresponding to the contour of the enclosure 23.

In the present embodiment, the first sub-enclosure 23*a* has a first contour 26*a* and the second sub-enclosure 23*b* has a second contour 26*b*. Preferably, the first monolithic block is mounted into the first sub-enclosure 23*a* in a form-fit manner corresponding to the first contour 26*a* of the first sub-enclosure 23*a*, and the second monolithic block is mounted into the second sub-enclosure 23*b* in a form-fit manner corresponding to the second contour 26*b* of the second sub-enclosure 23*b*.

When using one of the aforementioned methods to produce the porous monolithic blocks, then, for instance, each porous monolithic block 34*a*, 24*b* is made using its specific mold 61. These molds 61 may preferably each have a contour 62 which corresponds to the contour 26*a*, 26*b* of the relevant sub-enclosure 23*a*, 23*b*.

Figure 7:
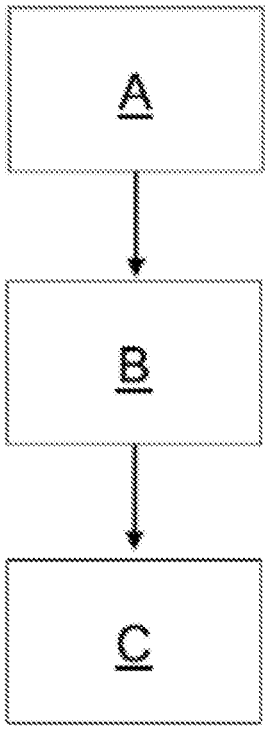
FIG. 7 is a flow chart.

FIG. 7 shows the steps for a method of manufacturing the loudspeaker 21 and the mobile phone 1, respectively. For manufacturing the loudspeaker 21 or the mobile phone 1, in step A, the plurality of porous particles may be provided. Then, in step B, the gas adsorbing materials 24*a*, 24*b* are produced by mixing the plurality of particles and the binder and producing a granulate or a porous block, particularly by means of one of the aforementioned methods. Then, in step C, the gas adsorbing materials 24*a*, 24*b* are mounted into the enclosure 23, particularly into the first and second sub-enclosures 23*a*, 23*b*. Preferably, the sub-enclosures are tightly filled with the gas adsorbing materials 24*a*, 24*b*.

If utilizing, for instance, for producing a granulate, a spray method, then the gas adsorbing materials 24*a*, 24*b* may be made by providing the plurality of porous particles, the binder, a nozzle and a freezer. Then, the binder and the plurality of particles 51 may be mixed and this mixture may be sprayed though the nozzle and frozen. By means of this a granulate consisting of grains of desired diameters can be achieved.

If utilizing, for instance, for producing a granulate, a method using a drum, then the gas adsorbing materials 24*a*, 24*b* may be made by providing the plurality of porous particles, the binder and a drum. Then, the binder and the plurality of particles 51 may be mixed in the rotating drum to obtain a granulate with grains of desired diameter.

It should be mentioned that all methods known in the art to produce a granulate can in principle be used for the present purpose.

If utilizing, for instance, for producing a monolithic porous block the freezing casting method, then the gas adsorbing materials 24*a*, 24*b* may be made by providing the plurality of porous particles, the binder and the mold 61 whose contour 62 corresponds to the contour 26*a*, 26*b* of the first and second sub-enclosure 23*a*, 23*b*. Then, the binder and the plurality of particles 51 may be mixed and this mixture may be filled into the mold 61. Then, the mold 61 filled with the mixture of the plurality of particles 51 and the binder is frozen in order to produce the relevant gas adsorbing materials 24*a*, 24*b*. Then, the mold 61 is removed from the gas adsorbing materials 24*a*, 24*b*.

If utilizing, for instance, for producing a monolithic porous block the freezing foaming method, then the gas adsorbing material may be made by providing the plurality of porous particles, the binder, the mold 61 whose contour 62 corresponds to the contour 26*a*, 26*b* of the first and second sub-enclosure 23*a*, 23*b*. Then, the binder and the plurality of particles 51 may be mixed and this mixture may be filled into the mold 61. Then, the ambient pressure around the mold 61 filled with the mixture of the plurality of particles 51 and the binder is reduced in order to produce the relevant porous gas adsorbing materials 24*a*, 24*b*. Then, the mold 61 is removed from the porous gas adsorbing material 24*a*, 24*b*.

If utilizing, for instance, for producing a monolithic porous block the sintering method, then the porous gas adsorbing material 24*a*, 24*b* may be made by providing the plurality of porous particles, the binder, and the mold 61 whose contour 62 corresponds to the contour 26*a*, 26*b* of the first and second sub-enclosure 23*a*, 23*b*. Then, the binder and the plurality of particles 51 may be mixed and this mixture may be filled into the mold 61. Then, the mold 61 filled with the mixture of the plurality of particles 51 and the binder is heated in order to produce the relevant gas adsorbing material 24*a*, 24*b*. During the heating, the binder burns at least partially. For example, two different kinds of binders may be used. One type of binder is a temporary binder which burns during the heating creating the first pores 27. Another type of binder may not burn during the heating. Then, the mold 61 is removed from the gas adsorbing material 24*a*, 24*b*. Alternatively, the foaming of the plurality of particles 51 can also be achieved by a ceramic foaming method.

If utilizing, for instance, the self-curing binding method, then the gas adsorbing material blocks 24*a*, 24*b* may be made by providing a protein foam as a structuring agent, the plurality of porous particles, the binder, and the mold 61 whose contour 62 corresponds to the contour 26*a*, 26*b* of the first and second sub-enclosure 23*a*, 23*b*. Then, the protein foam, the binder and the plurality of particles 51 may be mixed and this mixture may be filled into the mold 61. Then, one has to wait until the mixture filled into the mold 61 self-cures in order to produce the relevant porous gas adsorbing material 24*a*, 24*b*. Then, the mold 61 is removed from the gas adsorbing material 24*a*, 24*b*.

In closing, it should be noted that the disclosure is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present disclosure. The scope of the present disclosure is defined by the appended claims, including known equivalents and unforeseeable equivalents at the time of filing of this application.

What is claimed is:

1. A loudspeaker, comprising an enclosure;

a dynamic driver mounted in the enclosure; and a gas adsorbing material comprising porous particles and a binder, the particles being embedded in the binder and the gas adsorbing material mounted in the enclosure, wherein the binder has a solid content of at least 30 percent by weight with regard to the total weight of the binder, and wherein the gas adsorbing material forms a porous monolithic block, wherein the enclosure comprises a sub-enclosure, and the sub-enclosure is tightly filled with the gas adsorbing material which forms the porous monolithic block.

2. The loudspeaker of claim 1, wherein the porous particles comprise a zeolite material.

3. The loudspeaker of claim 1, wherein the porous particles have diameters of between about 2 μm and about 10 μm.

4. The loudspeaker of claim 1, wherein the binder comprises at least one of a sodium carboxymethyl cellulose (CMC), a poly carbon acid, a bentonite, a Glycerin, an Ethylene-glycol and a methacrylic ester-acrylic ester copolymer.

5. The loudspeaker of claim 1, wherein the binder comprises color-pigments.

6. The loudspeaker of claim 1, wherein the porous particles comprise activated carbon.

7. A mobile device, comprising a loudspeaker according to claim 1.

8. The loudspeaker of claim 1, wherein the porous monolithic block comprises a plurality of first pores, and the plurality of first pores is formed by at least partially burning away the binder.

* * * * *